US007927257B2

(12) United States Patent
Patel

(10) Patent No.: US 7,927,257 B2
(45) Date of Patent: Apr. 19, 2011

(54) ASSISTED STAIR TRAINING MACHINE AND METHODS OF USING

(76) Inventor: Rakesh Patel, Flushing, NY (US)

( * ) Notice: Subject to any disclaimer, the term of this patent is extended or adjusted under 35 U.S.C. 154(b) by 0 days.

(21) Appl. No.: 12/603,581

(22) Filed: Oct. 21, 2009

(65) Prior Publication Data

US 2010/0099541 A1 Apr. 22, 2010

Related U.S. Application Data

(60) Provisional application No. 61/107,326, filed on Oct. 21, 2008.

(51) Int. Cl.
*A63B 22/02* (2006.01)
*A63B 22/04* (2006.01)
*A63B 26/00* (2006.01)

(52) U.S. Cl. ..... 482/52; 482/54; 482/142

(58) Field of Classification Search ..... 482/51, 482/52, 54, 142
See application file for complete search history.

(56) References Cited

U.S. PATENT DOCUMENTS

| | | | | | |
|---|---|---|---|---|---|
| 2,819,755 | A | * | 1/1958 | Berger et al. | 482/69 |
| 3,497,215 | A | * | 2/1970 | Harrison et al. | 482/53 |
| 3,592,465 | A | * | 7/1971 | Fulkerson, Jr. | 482/39 |
| 3,743,283 | A | * | 7/1973 | Garrett | 482/52 |
| 3,970,302 | A | | 7/1976 | McFee | |
| 4,416,293 | A | * | 11/1983 | Anderson et al. | 600/595 |
| 4,555,108 | A | * | 11/1985 | Monteiro | 482/53 |
| 4,655,447 | A | * | 4/1987 | Dubrinsky et al. | 482/69 |
| 4,676,501 | A | * | 6/1987 | Hoagland et al. | 482/51 |
| 4,687,195 | A | * | 8/1987 | Potts | 482/52 |
| 4,720,093 | A | * | 1/1988 | Del Mar | 482/52 |
| 4,846,458 | A | * | 7/1989 | Potts | 482/26 |
| 4,861,021 | A | * | 8/1989 | Edwards et al. | 482/69 |
| 4,898,378 | A | * | 2/1990 | Edwards et al. | 482/54 |
| 4,901,385 | A | | 2/1990 | Adolphson | |
| 5,162,029 | A | * | 11/1992 | Gerard | 482/71 |
| 5,180,351 | A | | 1/1993 | Ehrenfried | |

(Continued)

FOREIGN PATENT DOCUMENTS

JP 2000-308661 11/2000

(Continued)

OTHER PUBLICATIONS

International Search Report and Written Opinion for PCT/2009/061564, mailed Jun. 4, 2010.

(Continued)

*Primary Examiner* — Rinaldi I Rada
*Assistant Examiner* — Robert F Long
(74) *Attorney, Agent, or Firm* — Edwards Angell Palmer & Dodge LLP

(57) ABSTRACT

An assisted stair training machine. The machine includes a stationary platform having a planar upper surface positioned parallel to a reference plane and at a predetermined distance above the reference plane; a movable platform having a planar upper surface and being configured to move from a first position to a second position, and a lifting mechanism. The planar upper surface of the movable platform is substantially level with the reference plane in the first position, and the planar upper surface of the movable platform is substantially level with the planar upper surface of the stationary platform in the second position. The lifting mechanism is configured to move the movable platform from the first position to the second position and from the second position back to the first position at a predetermined speed.

12 Claims, 14 Drawing Sheets

U.S. PATENT DOCUMENTS

| | | | | | |
|---|---|---|---|---|---|
| RE34,212 | E | * | 4/1993 | Potts | 482/26 |
| 5,207,621 | A | * | 5/1993 | Koch et al. | 482/53 |
| 5,242,341 | A | * | 9/1993 | Yeh | 482/52 |
| 5,308,300 | A | | 5/1994 | Chino et al. | |
| 5,312,313 | A | * | 5/1994 | Holmes et al. | 482/95 |
| 5,328,420 | A | * | 7/1994 | Allen | 482/52 |
| 5,346,444 | A | * | 9/1994 | Hsieh | 482/53 |
| 5,352,166 | A | * | 10/1994 | Chang | 482/52 |
| 5,399,134 | A | | 3/1995 | Abboudi et al. | |
| 5,437,588 | A | * | 8/1995 | Abboudi et al. | 482/54 |
| 5,490,818 | A | * | 2/1996 | Haber et al. | 482/52 |
| 5,496,241 | A | | 3/1996 | Sellers | |
| 5,499,959 | A | * | 3/1996 | Holmes et al. | 482/95 |
| 5,527,245 | A | * | 6/1996 | Dalebout et al. | 482/54 |
| 5,536,225 | A | * | 7/1996 | Neuberg et al. | 482/71 |
| 5,536,226 | A | | 7/1996 | Gordon | |
| 5,540,638 | A | * | 7/1996 | Wilkinson | 482/52 |
| 5,540,639 | A | * | 7/1996 | Potts et al. | 482/95 |
| 5,542,892 | A | * | 8/1996 | Buhler | 482/54 |
| 5,556,352 | A | * | 9/1996 | Chang | 482/52 |
| 5,651,753 | A | * | 7/1997 | Wilkinson | 482/52 |
| 5,667,461 | A | * | 9/1997 | Hall | 482/69 |
| 5,749,808 | A | * | 5/1998 | Harris | 482/52 |
| 5,769,759 | A | * | 6/1998 | Alter et al. | 482/37 |
| 5,901,813 | A | | 5/1999 | Orgal | |
| 5,924,960 | A | * | 7/1999 | Cohen | 482/51 |
| 5,941,800 | A | * | 8/1999 | Laconis | 482/70 |
| 5,984,839 | A | * | 11/1999 | Corkum | 482/54 |
| 6,168,548 | B1 | * | 1/2001 | Fleming | 482/23 |
| 6,217,484 | B1 | * | 4/2001 | Harshman et al. | 482/51 |
| 6,419,611 | B1 | * | 7/2002 | Levine et al. | 482/53 |
| 6,450,923 | B1 | * | 9/2002 | Vatti | 482/8 |
| 6,645,126 | B1 | * | 11/2003 | Martin et al. | 482/54 |
| 6,666,798 | B2 | * | 12/2003 | Borsheim | 482/54 |
| 6,783,482 | B2 | * | 8/2004 | Oglesby et al. | 482/54 |
| 6,991,588 | B1 | * | 1/2006 | Adams | 482/71 |
| 7,101,317 | B2 | * | 9/2006 | Kuo | 482/54 |
| 7,115,076 | B2 | * | 10/2006 | Oglesby et al. | 482/54 |
| 7,185,741 | B1 | * | 3/2007 | Rozenfeld | 187/200 |
| 7,303,508 | B2 | * | 12/2007 | Toyama et al. | 482/51 |
| 7,314,435 | B2 | * | 1/2008 | Schlosser | 482/69 |
| 7,335,147 | B2 | * | 2/2008 | Jones et al. | 482/148 |
| 7,494,450 | B2 | * | 2/2009 | Solomon | 482/69 |
| 7,520,836 | B2 | * | 4/2009 | Couvillion et al. | 482/8 |
| 7,594,877 | B2 | | 9/2009 | Anderson et al. | |
| 7,674,206 | B2 | * | 3/2010 | Jones | 482/54 |
| 2002/0045517 | A1 | * | 4/2002 | Oglesby et al. | 482/51 |
| 2002/0130951 | A1 | * | 9/2002 | Kurono | 348/61 |
| 2004/0038779 | A1 | * | 2/2004 | Kuo | 482/52 |
| 2005/0255971 | A1 | * | 11/2005 | Solomon | 482/54 |
| 2006/0009329 | A1 | * | 1/2006 | Toyama et al. | 482/51 |
| 2006/0009332 | A1 | * | 1/2006 | Jones | 482/54 |
| 2006/0160667 | A1 | * | 7/2006 | Oglesby et al. | 482/54 |
| 2007/0066466 | A1 | * | 3/2007 | Jones et al. | 482/148 |
| 2007/0161466 | A1 | * | 7/2007 | Oglesby et al. | 482/54 |
| 2008/0070757 | A1 | * | 3/2008 | Albert | 482/54 |
| 2009/0048074 | A1 | | 2/2009 | Kamins | |
| 2009/0239715 | A1 | | 9/2009 | Nelson et al. | |
| 2010/0035727 | A1 | * | 2/2010 | Brunner | 482/8 |

FOREIGN PATENT DOCUMENTS

| | | |
|---|---|---|
| KR | 10-2003-0055195 | 7/2003 |

OTHER PUBLICATIONS

DPE Medical Ltd., Physiotherapy Equipment, "Dynamic Stair Trainer—DST", http://www.dpemed.com/Dynamic-Stair-Trainer—DST.htm.

* cited by examiner

Fig. 6
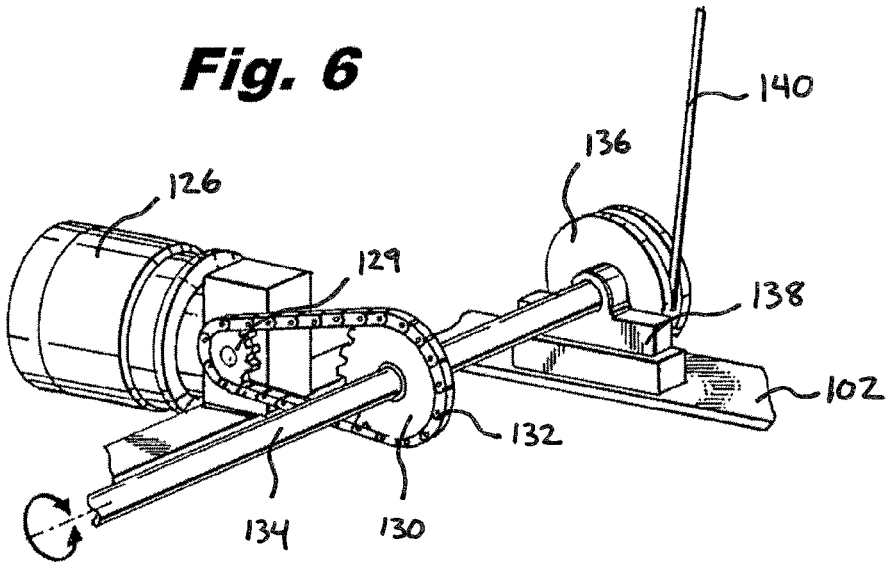
Fig. 7
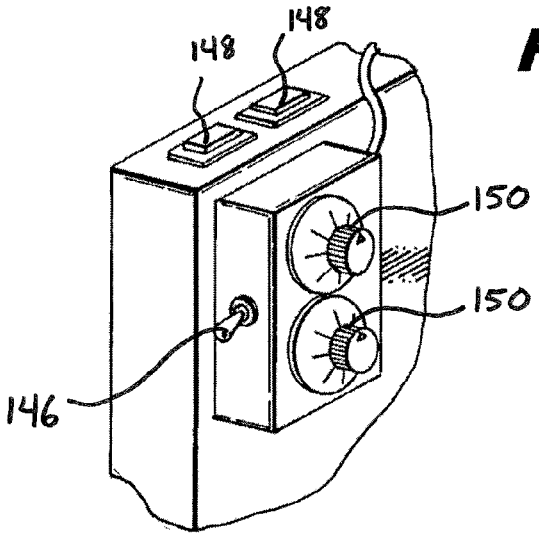
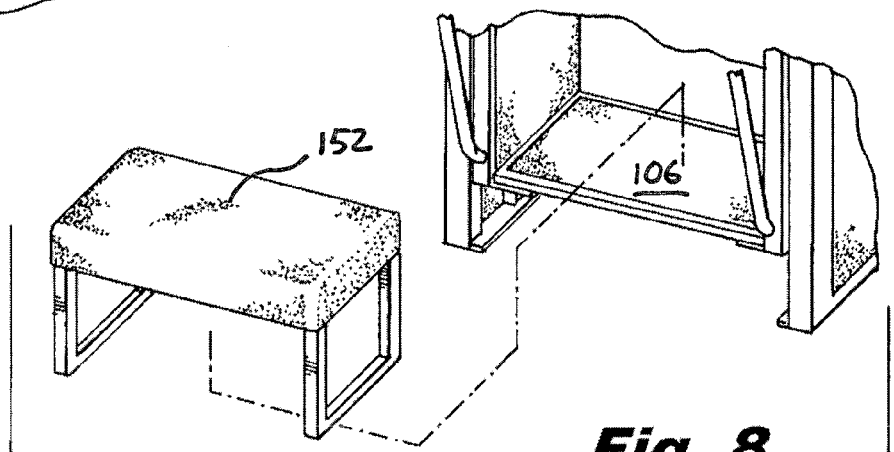
Fig. 8

ASSISTED STAIR TRAINING MACHINE AND METHODS OF USING

CROSS REFERENCE TO RELATED APPLICATION

This application claims priority to U.S. Provisional Patent Application No. 61/107,326, filed Oct. 21, 2008, the disclosure of which is incorporated by reference herein in its entirety.

BACKGROUND OF THE INVENTION

1. Field of the Invention

The present invention is directed to a machine and methods for controlled stair training and sit-to-stand training. More specifically, the present invention is directed to a machine and methods for assisting physical therapy patients in effective stair training and sitto-stand training while avoiding incorrect movements that could lead to injury.

2. Background of the Related Art

Physical therapy patients are usually trained for stair climbing using isolated steps that vary in height, for example, from two inches up to eight inches. This training can be extremely difficult for older patients, for patients suffering from severe injuries to their lower extremities, and for patients recovering from major surgeries such as hip or knee surgery. During stair training, these patients may end up using incorrect biomechanics and muscle strategies, such as using the hamstring for knee extension, or forceful knee locking, rather than the correct muscle strategy of using the quadriceps and gluteals to go up the step. The incorrect biomechanics may aggravate existing injuries and may make the patient susceptible to other knee, hip, and lower back injuries. Accordingly, there is a need for an apparatus and methods that can help a patient train effectively for stairs while avoiding incorrect movements that may lead to further injury. The stair training machine and methods of using the machine, as described below and in the attached drawings, meet this need.

SUMMARY OF THE INVENTION

Advantages of the present invention will be set forth in and become apparent from the description that follows. Additional advantages of the invention will be realized and attained by the methods and systems particularly pointed out in the written description and claims, as well as from the appended drawings.

To achieve these and other advantages and in accordance with the purpose of the invention, as embodied herein, the invention includes an assisted stair training machine. The machine includes a stationary platform having a planar upper surface positioned parallel to a reference plane and at a predetermined distance above the reference plane; a movable platform having a planar upper surface and being configured to move from a first position, wherein the planar upper surface of the movable platform is substantially level with the reference plane, to a second position, wherein the planar upper surface of the movable platform is substantially level with the planar upper surface of the stationary platform; and a lifting mechanism, configured to move the movable platform from the first position to the second position and from the second position back to the first position at a predetermined speed.

A method of performing a stair training exercise is also provided. The method includes the steps of placing a foot of an affected leg on a stationary platform having a planar upper surface positioned parallel to a reference plane and at a predetermined distance above the reference plane; placing a foot of the other leg on a movable platform having a planar upper surface and being configured to move from a first position, wherein the planar upper surface of the movable platform is substantially level with the reference plane, to a second position, wherein the planar upper surface of the movable platform is substantially level with the planar upper surface of the stationary platform; and moving the movable platform between the first position and the second position using a lifting mechanism, wherein lifting mechanism moves the movable platform at a predetermined speed in an upward direction and at a predetermined speed in a downward direction.

A method of performing a stand-to-sit training exercise is also provided. The method includes the steps of sitting on a stationary platform having a planar upper surface positioned parallel to a reference plane and at a first predetermined height above the reference plane; placing both feet on a floor surface substantially co-planar with the reference plane; and moving the movable platform downward using a lifting mechanism from the first predetermined height above the reference plane to a second predetermined height above the reference plane.

A method of performing a stretching exercise is also provided. The method includes the steps of placing a first body part on a movable platform having a planar upper surface positioned parallel to a reference plane; placing a second body part on a floor surface substantially co-planar with the reference plane; moving the movable platform upward between an initial position, wherein the movable platform is positioned on the floor surface, to a second position, wherein the movable platform is positioned a predetermined height above the reference plane; and maintaining the movable platform at the second position for a predetermined amount of time.

BRIEF DESCRIPTION OF THE DRAWINGS

So that those skilled in the art to which the subject invention pertains will readily understand how the assisted stair training machine functions without undue experimentation, preferred embodiments of the machine and methods of using the machine will be described in detail below with reference to the following figures:

FIG. 6 is a detailed view of the motor, rotating shaft, drum, and cable that form a part of the lifting mechanism shown in FIGS. 3 to 5;

FIG. 7 is a detailed view of a control box that interfaces with the controller shown in

FIG. 3;

FIG. 8 is a detailed view of an assistance chair configured to be used with the movable platform of the machine shown in FIG. 1;

DETAILED DESCRIPTION OF PREFERRED EMBODIMENTS

The assisted stair training machine of the present invention allows for the functional rehabilitation of lower extremities by both eccentric and concentric strengthening of appropriate muscles while inhibiting the use of inappropriate muscles. The machine allows patients to regain strength and mobility required to negotiate stairs, to move from a sitting position to a standing position or vice versa, and to return to sports or simply to ordinary daily activities. For example, the machine is capable of providing functional strengthening of lower abdominals while completely inhibiting use of iliopsoas, providing functional quadriceps strengthening while completely inhibiting use of the hamstring and iliotibial band, providing functional eccentric hamstring strengthening without a concentric phase, providing functional facilitation of hip flexion with knee flexion and ankle dorsiflexion, and assisting patients who are unable to get into the prone position to achieve knee flexion beyond 90°.

The machine described in this disclosure is particularly useful for physical therapy patients because it allows both a patient and his or her physical therapist to monitor the patient's progress while maintaining proper technique to avoid injury and increase the effectiveness of stair training exercises.

Figure 1:
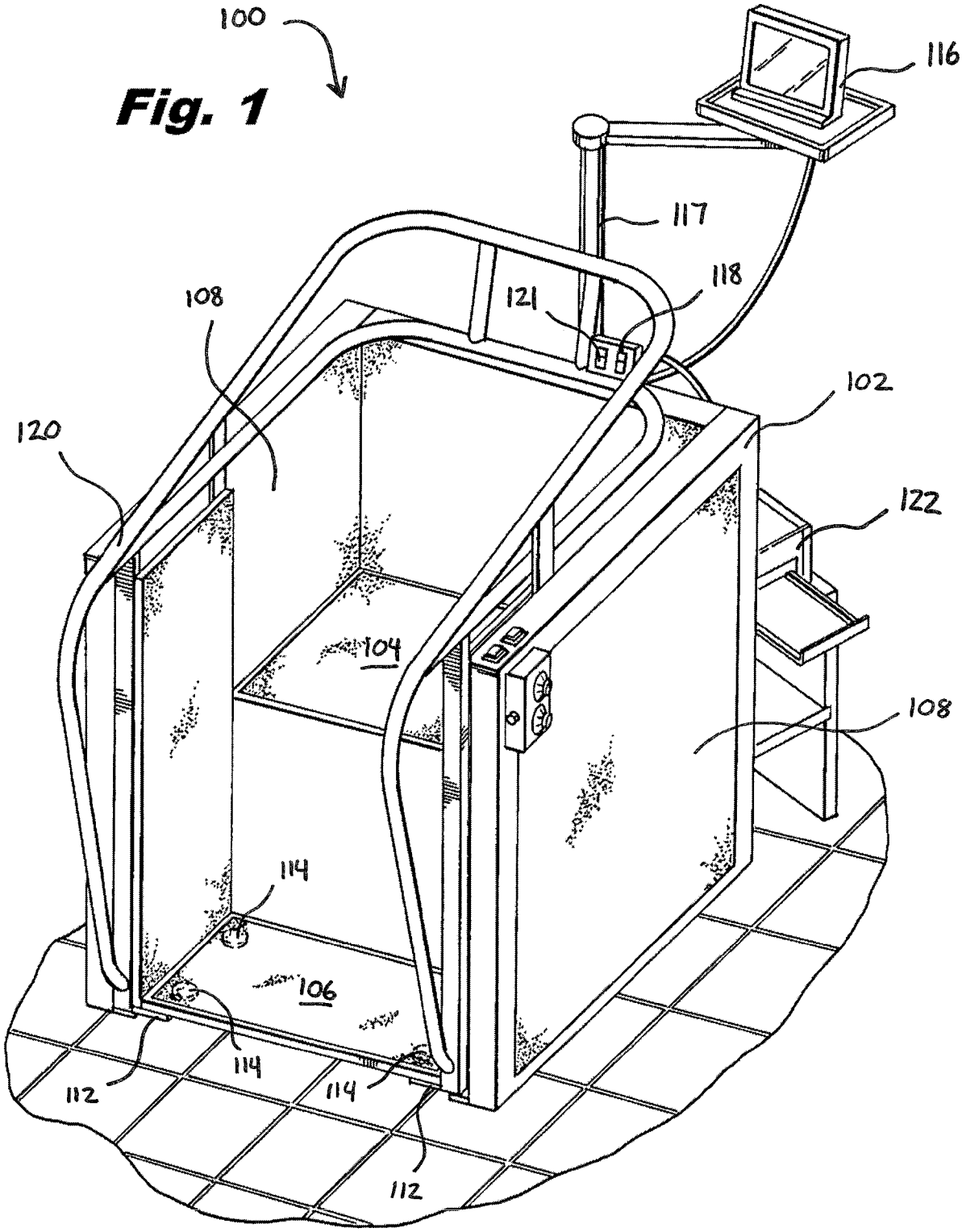
FIG. 1 is a perspective view of the assisted stair training machine of the present invention with a movable platform in a lower position.

Reference will now be made in detail to the present preferred embodiments of the stair training machine and methods. For purposes of explanation and illustration, and not limitation, an exemplary embodiment of an assisted stair training machine in accordance with the present invention is shown in FIG. 1 and designated generally by the reference numeral 100. Assisted stair training machine 100 includes a frame 102 surrounding a stationary platform 104 and a movable platform 106. As shown in FIG. 1, frame 102 may surround stationary step 104 on three sides, allowing a patient access to stationary platform 104 and movable platform 106 from the remaining open side. Frame 102 may also include a plurality of panels 108 attached to the frame to enclose the frame and to form three walls surrounding stationary platform 104.

Figure 2:
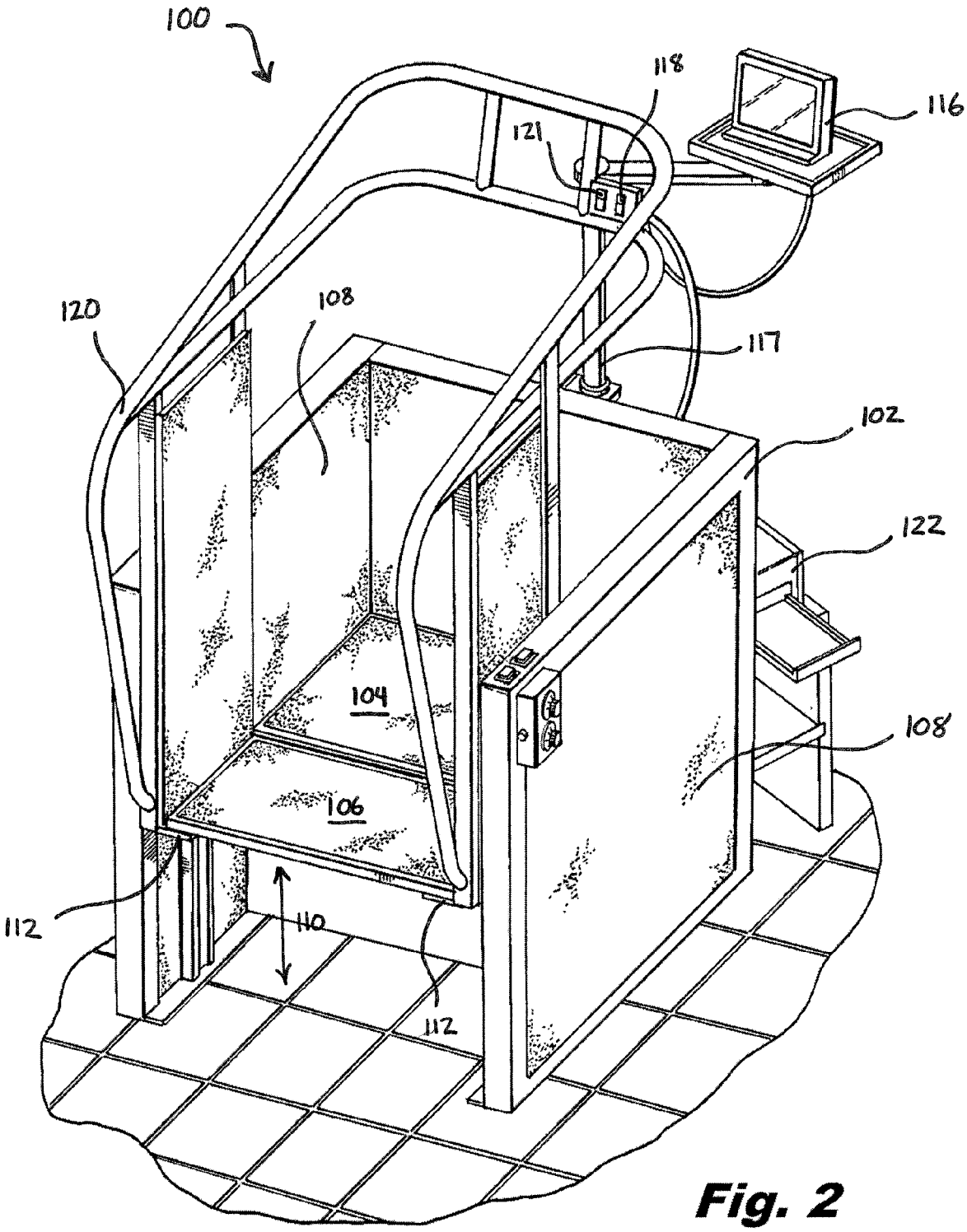
FIG. 2 is a perspective view of the assisted stair training machine of FIG. 1 with the movable platform in an upper position.

In operation, movable platform 106 travels in a vertical direction 110, as shown in FIG. 2, while maintaining a top surface of platform 106 substantially parallel to the ground on which machine 100 sits. Movable platform 106 travels at a predetermined speed from a lower position, as shown in FIG. 1, to an upper position, as shown in FIG. 2. In the exemplary embodiment shown, in the lower position, movable platform 106 rests just above the ground where it can be easily accessed by a patient, as shown in FIG. 1; while in the upper position, movable platform 106 is substantially level with stationary platform 104, as shown in FIG. 2. In addition, movable platform 106 is capable of moving to a position above the level of stationary platform 104. In one exemplary embodiment, stationary platform 104 includes measurement markings on a front wall portion of the stationary platform that will be visible when movable platform 106 is in the lower position and which provide an objective measure of a patient's progress when using machine 100.

In the exemplary embodiment shown, movable platform 106 is positioned on one or more lifting plates 112. As a safety feature, movable platform 106 may be removably positioned on lifting plates 112, allowing movable platform 106 to be removed when machine 100 is not in use. Assisted stair training machine 100 may also include a locking mechanism to secure movable platform 106 to lifting plates 112, thus preventing any tilting of movable platform 106 when weight is applied the front end of the movable platform by a patient while performing exercises using the machine.

Lifting plates 112 are moved up and down by a lifting mechanism located beneath stationary platform 104 or in another suitable location. The lifting mechanism can be powered by pneumatics, hydraulics, mechanical means, electrical means, or by a combination of these. In one exemplary embodiment, the lifting mechanism includes a motor connected to a series of pulleys, as will be described in more detail below.

In one exemplary embodiment, one or more pressure sensors 114, shown in phantom in FIG. 1, are positioned on an upper surface of lifting plates 112 such that when movable platform 106 is positioned on top of the lifting plates 112, pressure sensors 114 are sandwiched between movable platform 106 and lifting plates 112. In one exemplary embodiment, assisted stair training machine 100 includes two lifting plates 112, each having two evenly spaced pressure sensors 114. Pressure sensors 114 interface with a computer memory and display device 116 to record and display the amount of pressure applied to the movable platform by the patient at any given time during use of machine 100.

Computer 116 may be centrally mounted on an adjustable swivel arm 117 which allows computer 116 to be moved up and down and rotated to various positions on either side of the patient so that the patient and/or the physical therapist can receive feedback during use of machine 100. Use of multiple pressure sensors 114 allows the computer 116 to graphically and/or numerically display illustrations of separate weight data for both the heel and forefoot. This allows the physical therapist and the patient to determine the patient's weight bearing habits and to correct these habits if needed. In one exemplary embodiment, stationary platform 104 may also include sensors interfacing with computer 116 to display the pressure being applied to stationary platform 104 as well as movable platform 106.

Machine 100 may also include an electromyograph (not shown) that detects the electrical potential generated by the patient's muscle cells while using the machine. The electromyograph may also interface with the computer 116 such that the data it gathers can be stored and/or displayed. Assisted stair training machine 100 may also include a camera 118 mounted on the frame or in any other suitable location. Camera 118 may be configured to interface with computer 116 and to record and/or display visual feedback for the patient during use of machine 100.

Assisted stair training machine 100 may also include a railing 120 attached to frame 102 and surrounding stationary platform 104 on three sides, allowing the patient to grip railing 120 for support while using assisted stair training machine 100. Railing 120 may extend above frame 102 and also extend outward from frame 102 and downward toward the floor, as illustrated in FIGS. 1 and 2. Railing 120 may be connected to the lifting mechanism of assisted stair training machine 100 such that railing 120 is raised and lowered in unison with the raising and lowering of movable platform 106, thus providing stable support for the patient during use of machine 100. Railing 120 may also be adjustable in both height and length to accommodate variety of body types. In one exemplary embodiment, railing 120 includes integrated heart rate sensors such that when a patient grips the railing on either side, the heart rate sensors measure the patient's heart rate and send this information to computer 116 where it can be stored and/or displayed. An additional display device 121 showing the weight bearing on movable platform 106 and/or stationary platform 104 may be mounted to railing 120 to aid the patient and the physical therapist in viewing the data while certain exercises are being performed.

A printer 122 or other output device may also interface with computer 116. The printer may be integrated into assisted stair training machine 100, or it may be a stand-alone device. Use of printer 122 allows the patient's charts to be saved, given to the patient, or submitted to insurance companies during an evaluation or re-evaluation process. Computer 116 may also include functionality for sending and receiving wireless data.

Figure 3:
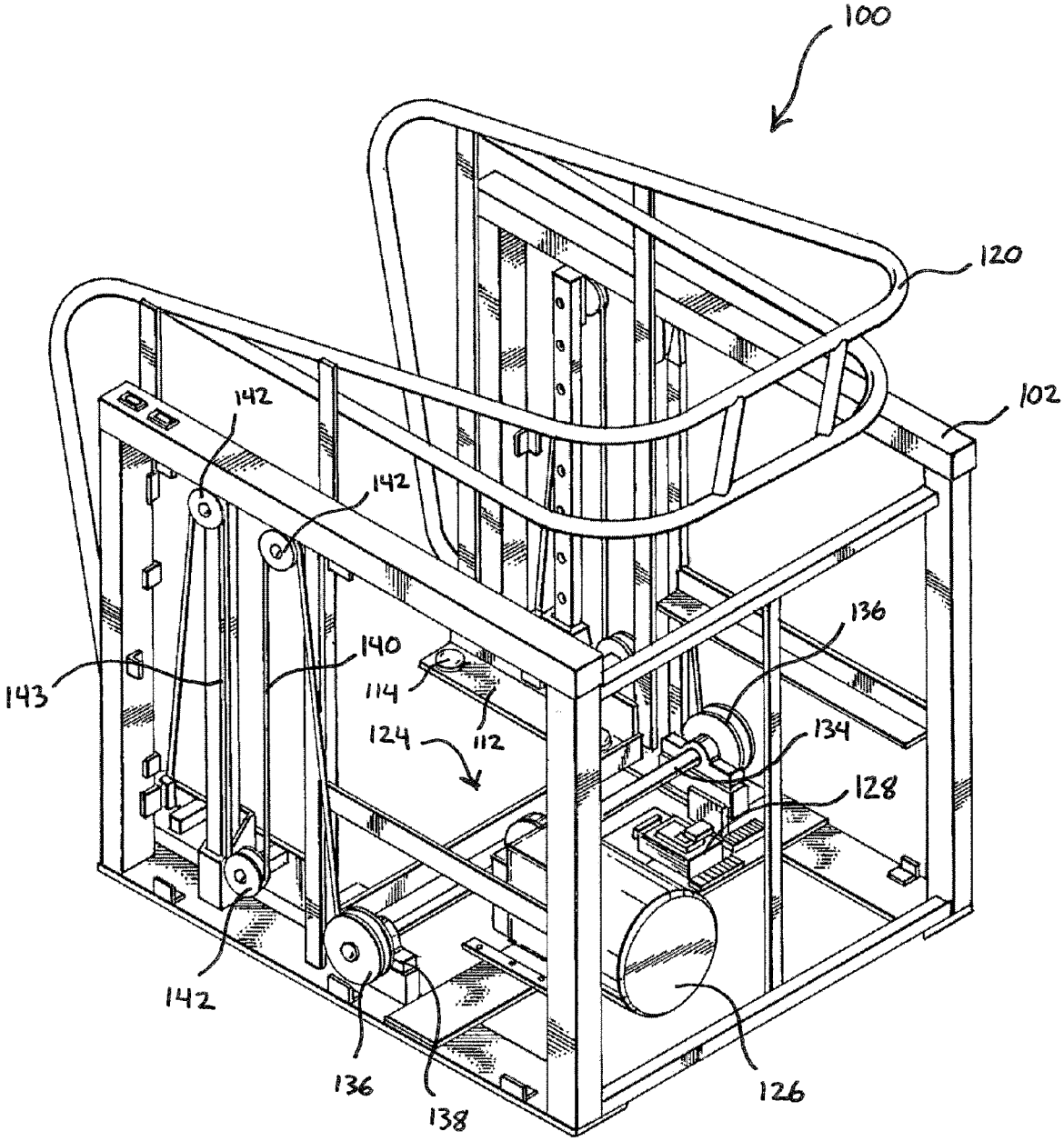
FIG. 3 is perspective view of the machine of FIG. 1 with frame panels removed to show the details of a lifting mechanism, including a controller, a motor, a rotating shaft and drum, a cable, and a plurality of pulleys.

FIG. 3 illustrate a perspective view of an exemplary embodiment of assisted stair training machine 100 with panels 108 removed, showing the details of a lifting mechanism 124 that is used to raise and lower movable platform 106. Lifting mechanism 124 includes a motor 126 interfacing with a controller 128. Controller 128 includes a circuit board and memory and is configured to control the speed and direction of motor 126.

Figure 4:
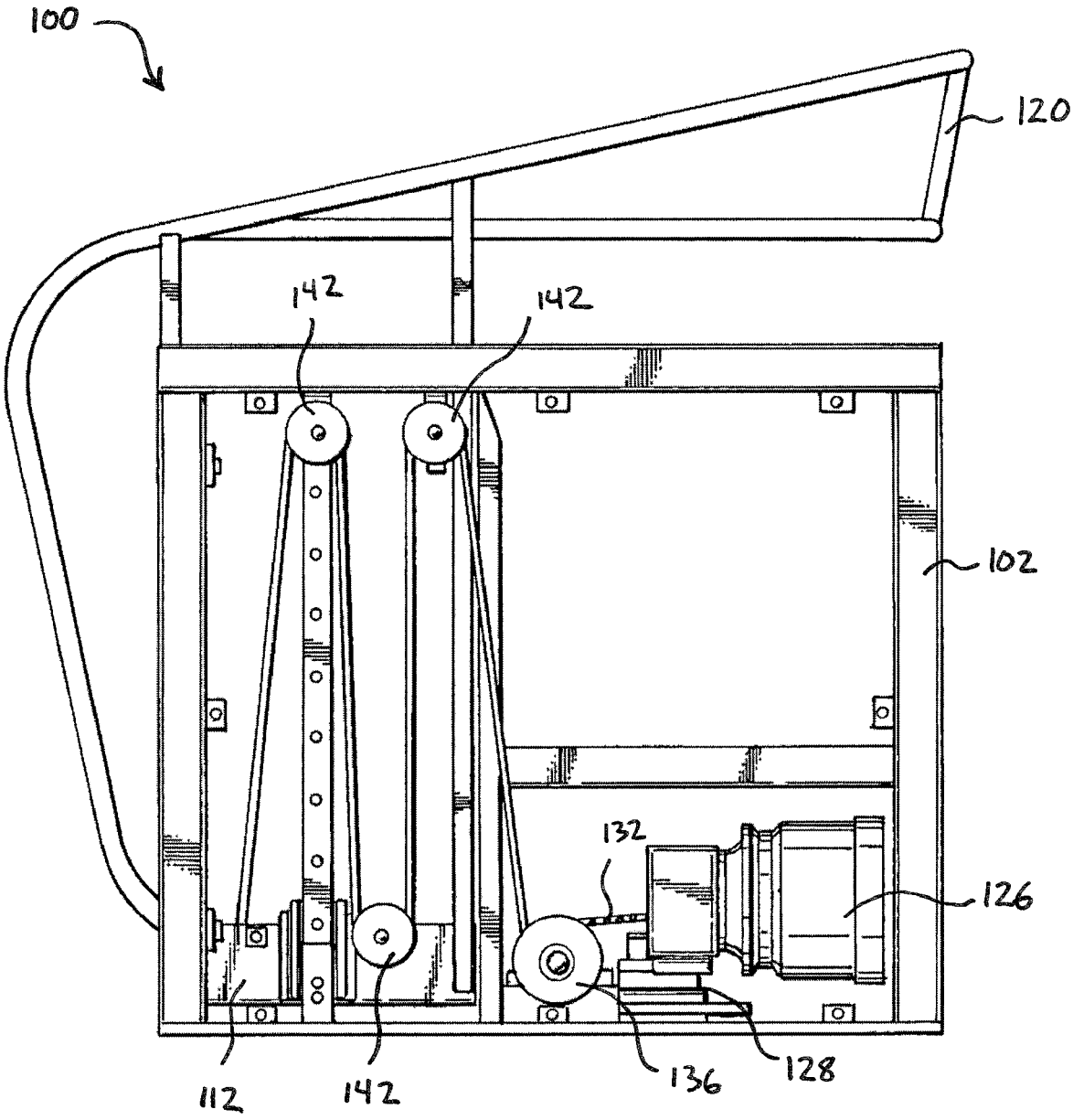
FIG. 4 is a side view of the machine as shown in FIG. 3, with the movable platform in the lower position.
Figure 5:
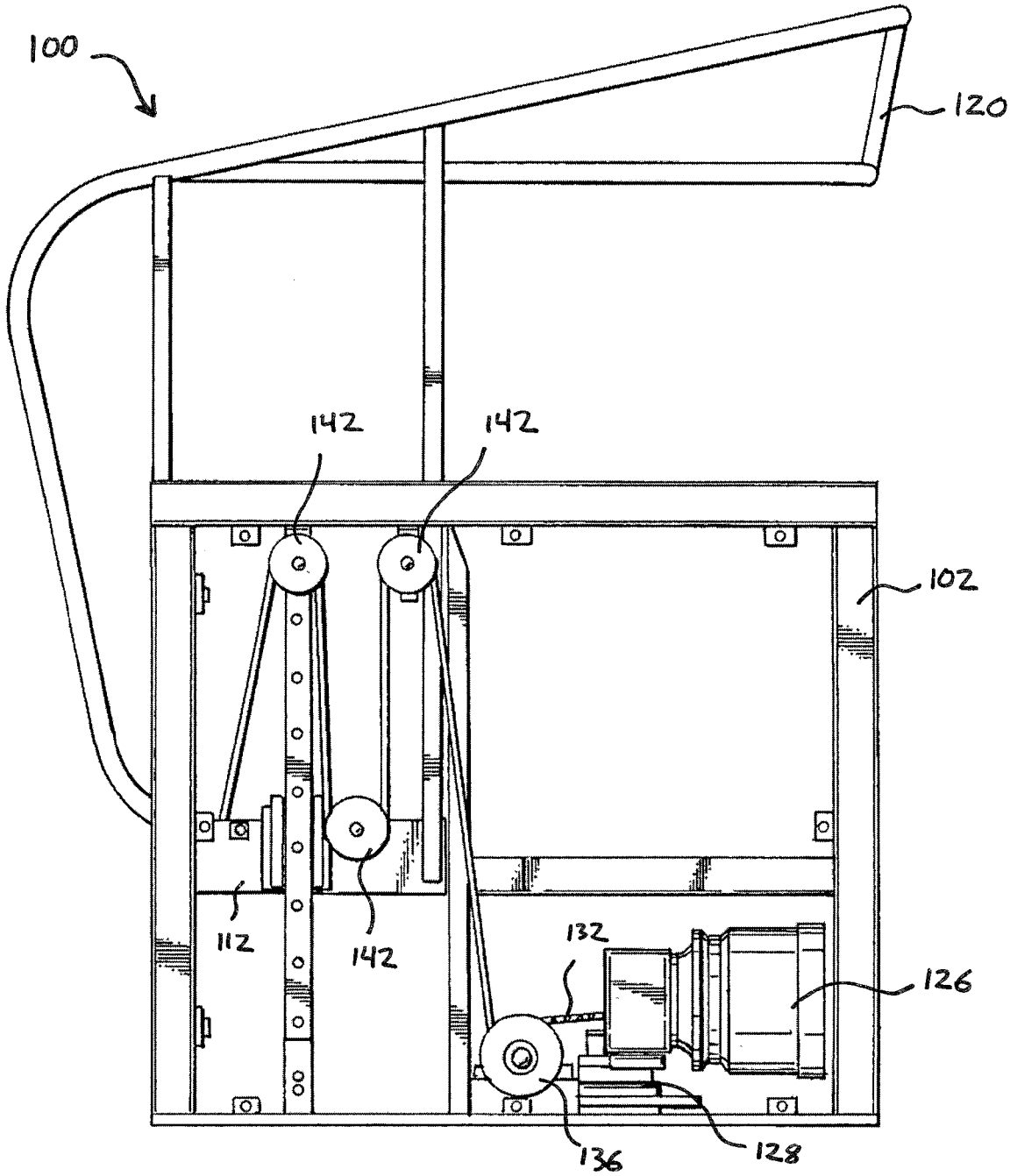
FIG. 5 is a side view of the machine as shown in FIG. 3, with the movable platform in the upper position.

FIGS. 3 and 4 illustrate a side view of assisted stair training machine 100 with panels 108 removed from frame 102. FIG. 3 illustrates assisted stair training machine 100 with movable platform 106 in the lower position; FIG. 4 illustrates assisted stair training machine 100 with movable platform 106 in the upper position.

FIG. 6 is a detailed view of motor 126. In the exemplary embodiment shown, motor 126 includes an output shaft rigidly connected to a first sprocket 129, which is in turn connected to a second sprocket 130 by a chain 132. In one exemplary embodiment, motor 126 includes a direct current motor and a right angle gear box having a 40 to 1 gear ratio. Second sprocket 130 is rigidly connected to a rotating shaft 134 near the center of the length of the shaft. In one exemplary embodiment, first sprocket 129 has 13 teeth and second sprocket 130 has 20 teeth. Each end of rotating shaft 134 is rigidly attached to a drum 136. Rotating shaft 134 is supported in frame 102 by a pillow block bearing 138 on each end of the shaft. A cable 140 is attached to drum 136 at a first end and to lifting plates 112 at a second end. Cable 140 also winds through one or more pulleys 142. Pulleys 142 may be made from nylon, and cable 140 may be coated for noise reduction. Additional pulleys 142 may be added or removed from assisted stair training machine 100 to increase speed or weight. Lifting plates 112, located on each side of assisted stair training machine 100, are each configured to slidably move up and down along a guide rail 143 rigidly attached to frame 102. In the exemplary embodiment shown in FIG. 3, assisted stair training machine 100 includes an identical configuration including drum 136, cable 140, and pulleys 142 on each side of frame 102 to provide redundancy for safety purposes. When machine 100 is in use, panels 108 are in place to conceal the lifting mechanism and protect the patient from injury from the moving parts of the lifting mechanism.

Controller 128 also interfaces with a control box 144, an up/down switch 146, and travel switches 148. Travel switches 148 may be located near the top of frame 102, as shown in FIG. 3. In one exemplary embodiment, travel switches 148 and up/down switch 146 are positioned on both sides of frame 102 for ease of use by the patient and the physical therapist. Travel switches 148 function to adjust the travel limits of movable platform 106.

Up/down switch 146 may be a toggle switch that functions to change the travel direction of movable platform 106. Control box 144 may also be mounted on frame 102 and may include controls for setting the speed at which movable platform 106 is raised or lowered. In one exemplary embodiment, shown in FIG. 7, control box 144 includes two dials 150, with each dial being connected to a potentiometer such that adjusting the dial 150 will adjust the speed of the motor. A first dial is used to adjust the speed of the output shaft of motor 126 in a clockwise direction; a second dial is used to adjust the speed of the motor 126 when the output shaft rotates in a counterclockwise direction. A hand-held remote control may also be used to interface with controller 128 and control the speed and direction of the movement of movable platform 106.

In operation, the patient or physical therapist adjusts the desired speed and travel limits of movable platform 106 by adjusting dials 150 and travel switches 148, respectively. The patient or physical therapist will then engage up/down switch 146 in either an up or a down position. Engaging up/down switch 146 sends a signal to controller 128, which in turn interfaces with motor 126, causing the output shaft of motor 126 to rotate a predetermined speed in either a clockwise or counterclockwise direction, depending on whether movable platform 106 is being raised or lowered. As the output shaft of motor 126 rotates, first sprocket 129 meshes with chain 132 and causes second sprocket 130 to rotate. Because second sprocket is rigidly attached to shaft 134, the rotation of second sprocket 130 causes shaft 134 to rotate in either a clockwise or counterclockwise direction. As shaft 134 rotates, drums 136 also rotate and either wind or unwind cable 140, which travels through pulleys 142 to raise or lower lifting plates 112 and movable platform 106.

The speed of the upward and downward movement of movable platform 106 will depend on the settings entered at control box 144. The physical therapist or patient may set a constant speed for movable platform 106, or they may set a variable speed. In addition, the speed of movable platform 106 can be manually changed during use of machine 100 to provide a acceleration or deceleration of movable platform 106.

Although a control box having physical dials and switches is shown in the drawings, it is contemplated that the control box may also include a keyboard, an electronic display, a touch screen, and/or any other interactive display and input device.

A separate speed can be selected for upward movement and downward movement. For example, the speed at which shaft 134 rotates during upward movement of movable platform 106 may be 90 rotations per minute (rpm), while the downward motion at which shaft rotates may be set at 40 rpm. In this example, the step moves upward faster than it moves downward, enabling the patient to feel more comfortable while going through concentric and eccentric phases of an exercise using assisted stair training machine 100. This feature is useful for patients in the initial phase of rehabilitation, because such patients are often unable to bear a load for a long period of time during the concentric phase of the exercise and are often unable to control the eccentric phase of the exercise at high speed.

In one exemplary embodiment, movable platform 106 can be automatically moved up and down for a specific number of repetitions. For example, the control box may be used to instruct controller 128 to move movable platform 106 through ten up and down repetitions. The speed of the movement may remain constant from repetition to repetition, or the speed may be set to change from one repetition to another or during the up and down phases of each repetition. In addition, movable platform 106 may accelerate or decelerate during any phase of the repetition.

FIG. 8 is a detailed view of an assistance chair 152 that functions as a removable seat that can be placed on movable platform 106 while performing certain exercises using assisted stair trainer machine 100. In one exemplary embodiment, the upward motion of movable platform 106 may be up to 25 inches. Assistance chair 152 may be 12 inches high, thus achieving a total of 37 inches of upward movement that is useful in various sit-to-stand and stand-to-sit exercises, as explained in further detail below. Assisted stair training machine 100 may also be used with one or more blocks that can be used to increase the height of stationary platform 104 or to otherwise assist a patient when performing exercises using machine 100. For example, a block that is 16 inches wide, 10 inches long, and either 4 inches or 8 inches in height may be used with machine 100. A mat may also be used to aid patients when performing exercises. For example, the mat may be 5 feet wide, 3 feet long, and 2 inches thick.

Assisted stair training machine 100 allows a patient to train for going up and down stairs by reducing his or her body weight, that is, by lifting his or her body using movable platform 106 for the initial phase of rehabilitation. This prevents the patient from using unnecessary muscles during rehabilitation that may be harmful and cause further injury, such as the locking of a knee by hamstring while going up the stair, increased pelvic rotation while going down the stair, and uncontrolled landing due to lack of eccentric strength in quadriceps while going down the stair.

When the patient gets stronger, he or she can try performing stair training exercises with full body weight on the affected leg at different speeds for different intensities. The patient may receive biofeedback from computer 116, which may display data regarding the amount of weight being put on the affected leg, meaning the leg that is being rehabilitated. Prior art solutions do not provide a way to train patients for stairs by decreasing the force needed to overcome gravity; going up even a two inch step requires the patient to use the quadriceps and gluteals to lift his or her entire body weight against gravity, which is not effective in strengthening weak muscles. Assisted stair training machine 100 allows patients with weight bearing limitations resulting from lower extremity pathologies and surgeries to train properly for stairs.

Patients with severe weakness in the quadriceps or a hyperactive hamstring while can be trained to inhibit the use of the hamstring and maximize quadriceps use without overloading the muscles using the controlled loading allowed by assisted stair training machine 100.

Machine 100 also allows patients with lower abdominal (external oblique) weakness and hyperactive or short hip flexors to strengthen lower abdominals without recruiting hip flexors in the functional standing position, as opposed to training in a supine, non-functional position traditionally used in physical therapy. Assisted stair training machine 100 eliminates hip flexor concentric contraction, which is the biggest challenge in external oblique training.

Assisted stair training machine 100 is also useful for older patients who are unable to get into the prone position after total knee replacement. Machine 100 allows these patients to perform knee flexion range of motion and strengthening while in a comfortable standing position. For most of the patient population, the conventional way of performing standing active knee flexion does not strengthen beyond 90° flexion range of motion.

Concentric contraction related hamstring spasm in patients with hyperactive hamstring can also be treated using assisted stair training machine 100. This training can be done in a functional eccentric way in a standing position, eliminating the need for the concentric contraction phase. This may be particularly useful in an athlete recovering from an anterior cruciate ligament reconstruction where eccentric hamstring strength with proper timing of recruitment is very important.

Machine 100 can also be used for patients with excessive lumbar spine extension during walking due to short rectus femoris and weak external obliques. Machine 100 can be used in these patients to increase knee flexion range of motion for normal walking with controlled elimination of excessive lumbar spine extension and with external oblique recruitment at the proper time and in a sufficient amount. Advantageously, machine 100 allows a patient to perform these exercises without getting into the traditional prone position where the patient may have difficulty recruiting the external oblique muscle.

Assisted stair training machine 100 is also beneficial for patients with brain damage who are having difficulties walking due to lack of hip flexion with knee flexion and ankle dorsiflexion. Using machine 100, these patients can be trained to inhibit forces that prevent this combination from happening. Using assisted stair training machine 100, patients learn the appropriate movements in a functional way with reduced gravity resistance and leg weight. Patients are forced to follow the speed of movable platform 106 by maintaining contact with the platform while applying as little weight on the affected extremity as possible. The effectiveness of the learning is increased with the help of biofeedback displayed on computer 116. This represents an improvement over prior art methods, which included having a therapist lift the patient's leg, which negatively affects the learning process due to lack of constant speed of movement, or involved issuing verbal commands to the patient to carry out the movement, which was also ineffective.

Using machine 100, patients with swayback postures and posterior pelvic tilt and weak iliopsoas can be trained to strengthen the iliopsoas in shortened position without losing proper lumbar spine alignment which happens when the patient attempts to lift his or her thigh up to assist in hip flexion. Assisted stair training machine 100 eliminates the need for the therapist to help lift the thigh up to avoid recruitment of tensor fascia latae and rectus femoris. Use of machine 100 allows the patient to focus on recruiting iliopsoas efficiently and to monitor his or her progress by viewing the biofeedback data on the display of computer 116.

Patients can also stretch short hamstring and calf muscles using machine 100, without straining their backs. Traditionally, physical therapists have had to stretch a patient's hamstrings manually or the patient performed a supine straight leg raise, which recruits unnecessary hip flexor muscles.

Patients with gluteus medius weakness with positive trendelenberg gait can be treated for single leg standing training in a controlled loading, comfortable, and stable manner. In prior art methods, patients performed a single leg stance with full weight bearing (excessive resistance) by holding on to something for support. This technique does not prevent trendelenberg sign and hip internal rotation or lumbar spine rotation from happening due to its uncontrolled and unsafe loading of the affected leg. Using assisted stair training machine 100, patients can gradually load the affected side while maintaining proper alignment of other body parts without using upper extremities, which amounts to limited weight bearing single leg standing training. This technique can also be used for patients with balance problems causing gait abnormalities.

Assisted stair training machine 100 can also be used for patients with gluteus medius weakness who are not allowed to perform weight bearing exercise. These types of patients usually have difficulty inhibiting tensor fascia latae in side-lying exercises. These patients can be treated in a controlled fashion with excellent recruitment of gluteus medius and inhibition of tensor fascia latae and obliques. Without the assistance of machine 100, a physical therapist would have to spend an great deal of time and energy to help a patient perform this exercise by manually guiding the patient's leg.

Patients with gluteus maximus weakness with hyperactive hamstrings and limited lower abdominal control and excessive lower spine extension with hip extension on walking can also benefit from use of assisted stair training machine 100. Such patients can be treated for gluteus maximus strengthening while inhibiting other unnecessary movements. Traditionally, a physical therapists would have to spend a lot of energy and time helping the patient do this exercise.

Patients with weight bearing limitations with knee extension lag can be treated by using machine 100 to perform active-assisted straight leg raises while maintaining the knee in full extension without putting extra load on weak quadriceps. Using assisted stair training machine 100, the physical therapist does not have to hold the patient's knee in complete extension during the exercise, nor does the patient have to use a brace, as with prior art methods.

Figure 9:
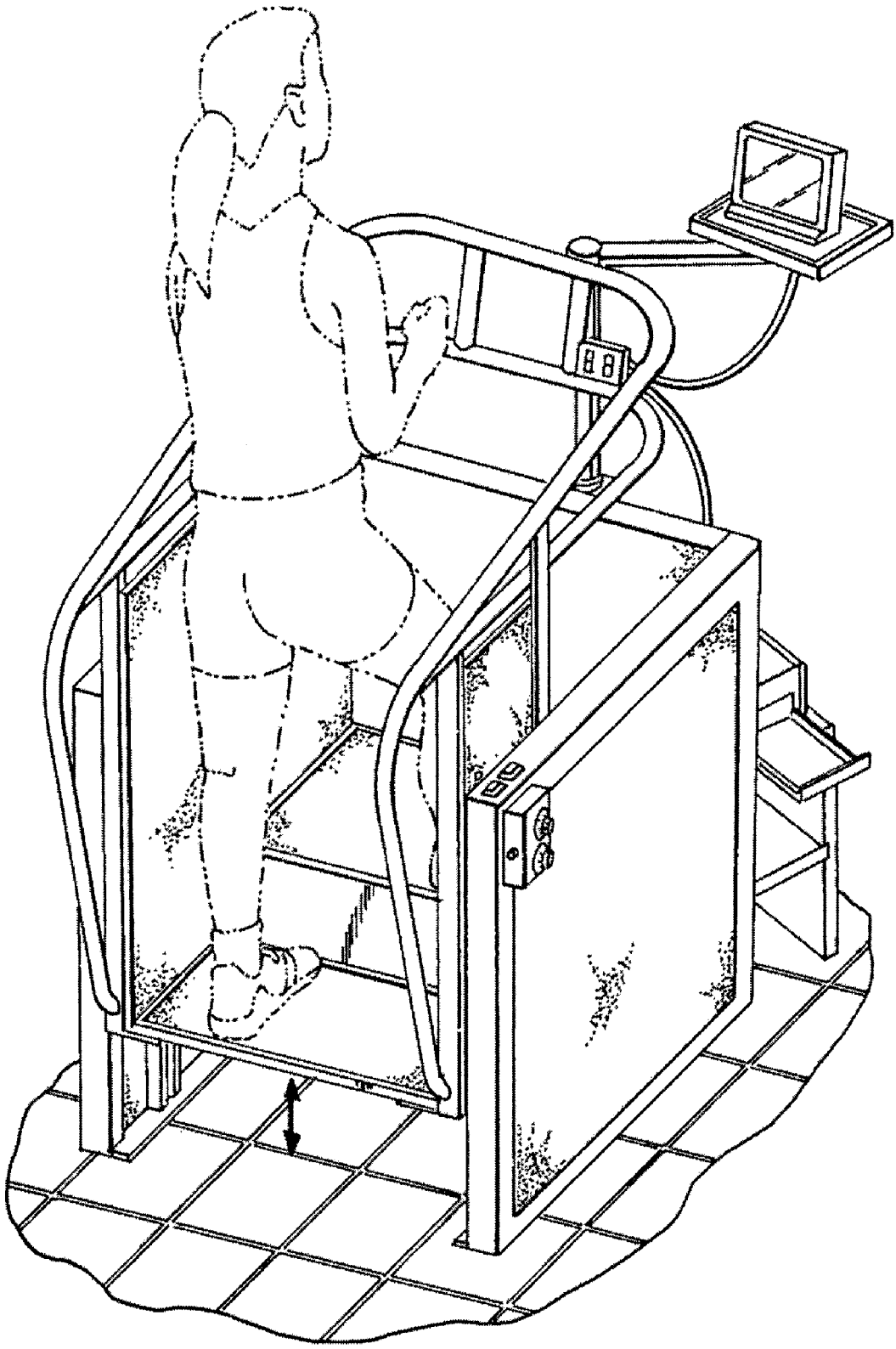
FIG. 9 illustrates the use of the machine of FIG. 1 to perform a stair training exercise in which a patient goes up a stair.

FIGS. 9-16 illustrate various methods of using the assisted stair training machine 100 of the present invention that may be useful in the treatment and rehabilitation of patients, as described above. FIG. 9 illustrates a patient performing a stair climbing exercise. In this exercise, the patient stands facing stationary platform 104. The patient then places the foot of her affected leg, that is, the leg that is being rehabilitated, on stationary platform 104 to activate the pressure sensor within stationary platform 104. Her other foot is placed on movable platform 106 while in the lower position. During this exercise, the patient may grip railing 120 for balance and a sense of safety, however, the aim should be to complete the exercise independently.

Once the patient is in position, up/down switch 146 is placed in the up position and the patient moves up to the upper step at the speed of movable platform 106 while maintaining as much weight as possible on the affected leg and as little weight as possible on the unaffected leg that is in contact with movable platform 106. The patient is also keeps the knee of the unaffected leg straight at all times during the exercise. The patient should try to continually increase the weight on the affected leg with every session as it becomes easier. Once the patient is able to carry nearly her full body weight independently on the affected leg at a specific speed, the difficulty of the exercise can be increased by decreasing the speed of the concentric phase and increasing the speed of the eccentric phase or vice versa. In one exemplary embodiment, the patient completes three sets of 6 to 10 repetitions of this exercise.

Figure 10:
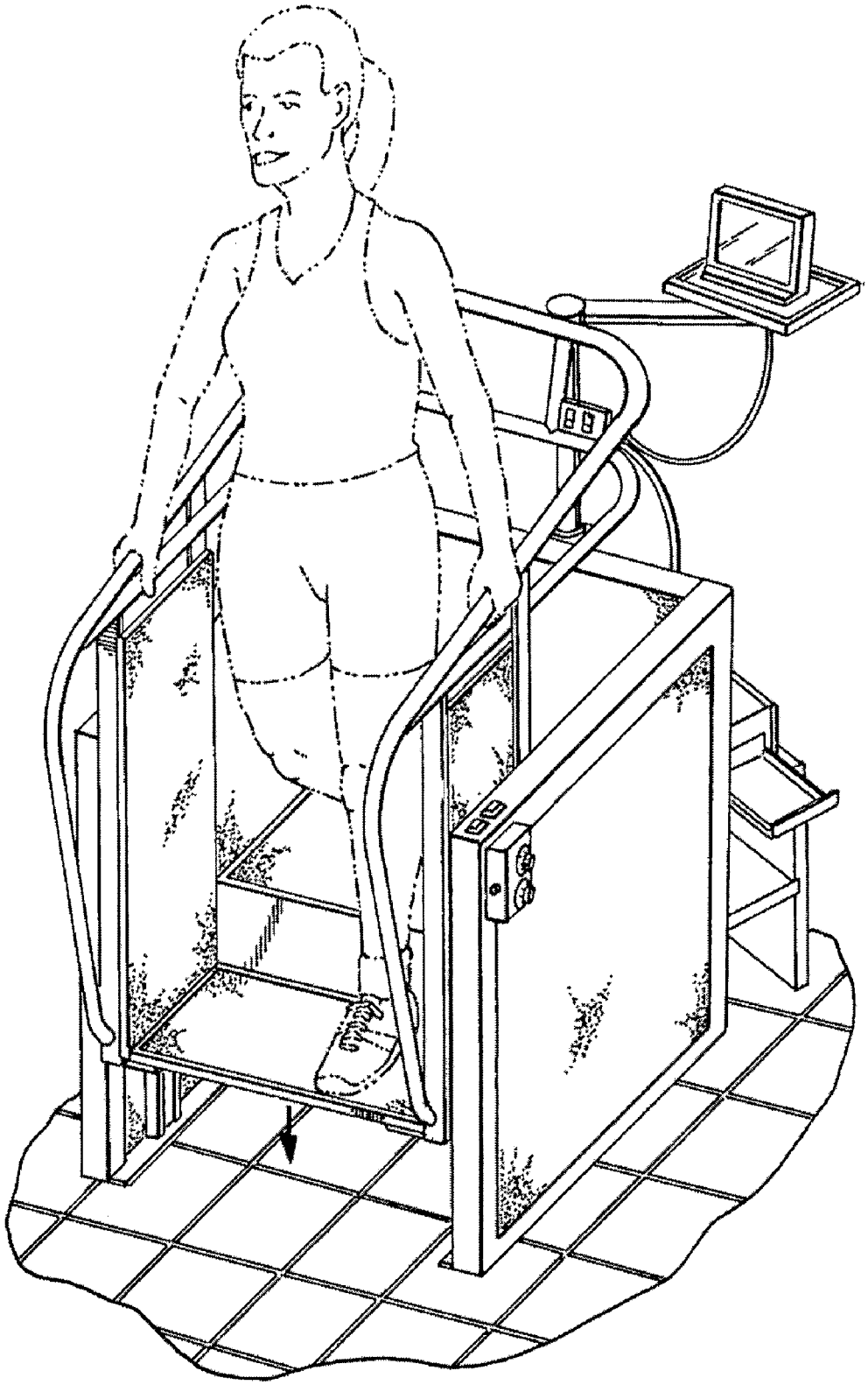
FIG. 10 illustrates the use of the machine of FIG. 1 to perform a stair training exercise in which a patient goes down a stair.

FIG. 10 illustrates the patient performing a stair descending exercise. In this exercise, movable platform 106 starts in the upper position, level with stationary platform 104. The patient stands facing either the lower step or facing sideways. The patient is then instructed to place the foot of the affected leg on the stationary platform and the foot of the other leg on the movable platform. Again, the patient may use railing 120 for support if needed. The patient is then instructed to try going down the step at the speed of movable platform 106, maintaining as much weight as possible on the affected leg and as little weight as possible on the unaffected leg while movable platform 106 is moving down and coming back up. During this exercise, the patient should keep the knee of the unaffected leg straight at all times. The patient should try to continually increase the weight on the affected leg with every session as it becomes easier. Once the patient is able to carry nearly her full body weight independently on the affected leg at a specific speed, the difficulty of the exercise can be increased by decreasing speed of the concentric phase and increasing speed of the eccentric phase or vice versa. In one exemplary embodiment, the patient completes three sets of 6 to 10 repetitions of this exercise.

Figure 11:
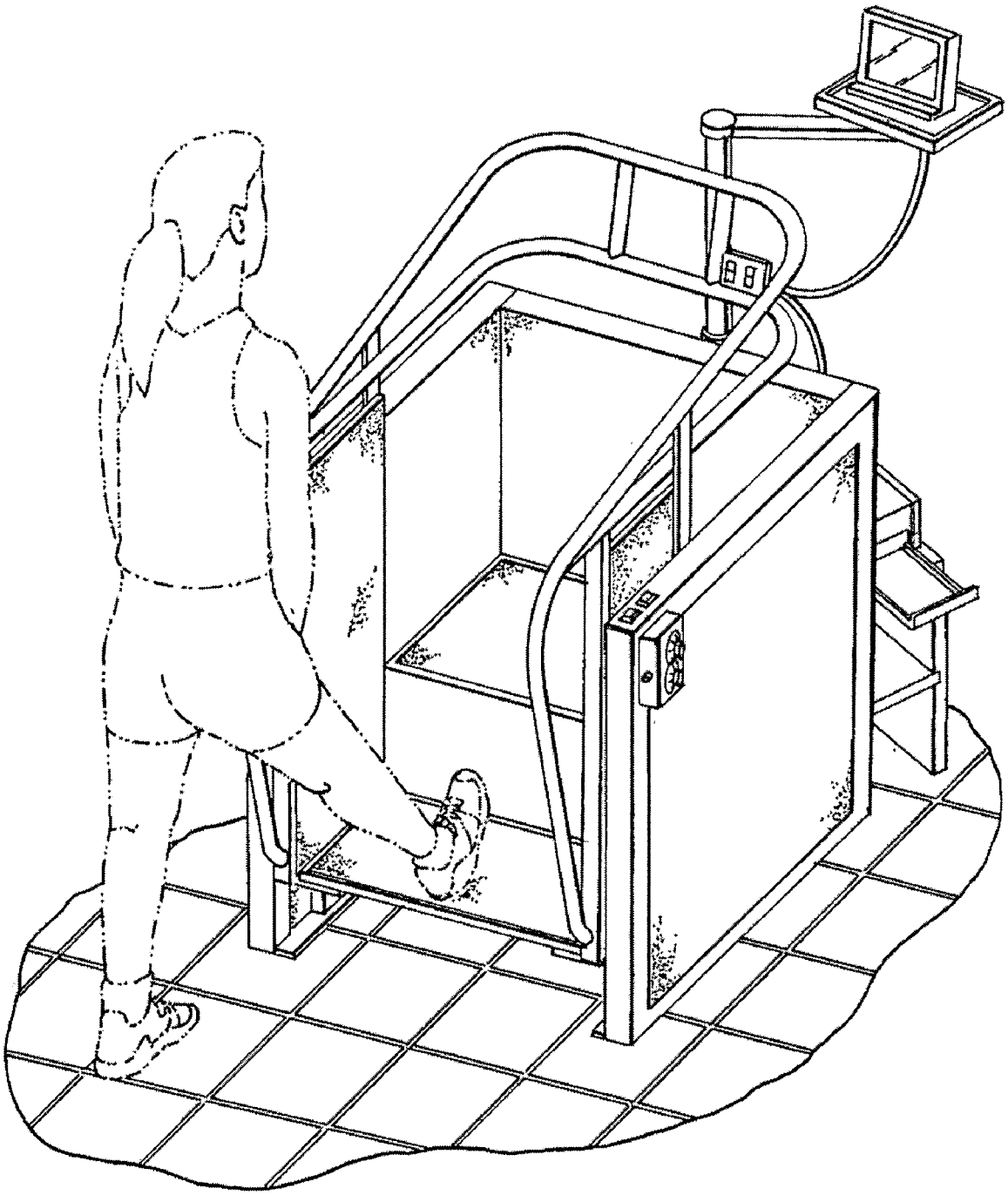
FIG. 11 illustrates the use of the machine of FIG. 1 to perform a hamstring stretch.

FIG. 11 illustrates the patient performing a hamstring stretch using assisted stair training machine 100. For this exercise, the patient stands facing the movable platform 106 in the lower position, that is, at its lowest height, as shown in FIG. 1. The patient then places her affected leg on movable platform 106. Up/down switch 146 is then activated such that movable platform 106 moves upward until the patient feels a good stretch in the hamstring without any knee or lumbar spine flexion.

Figure 12:
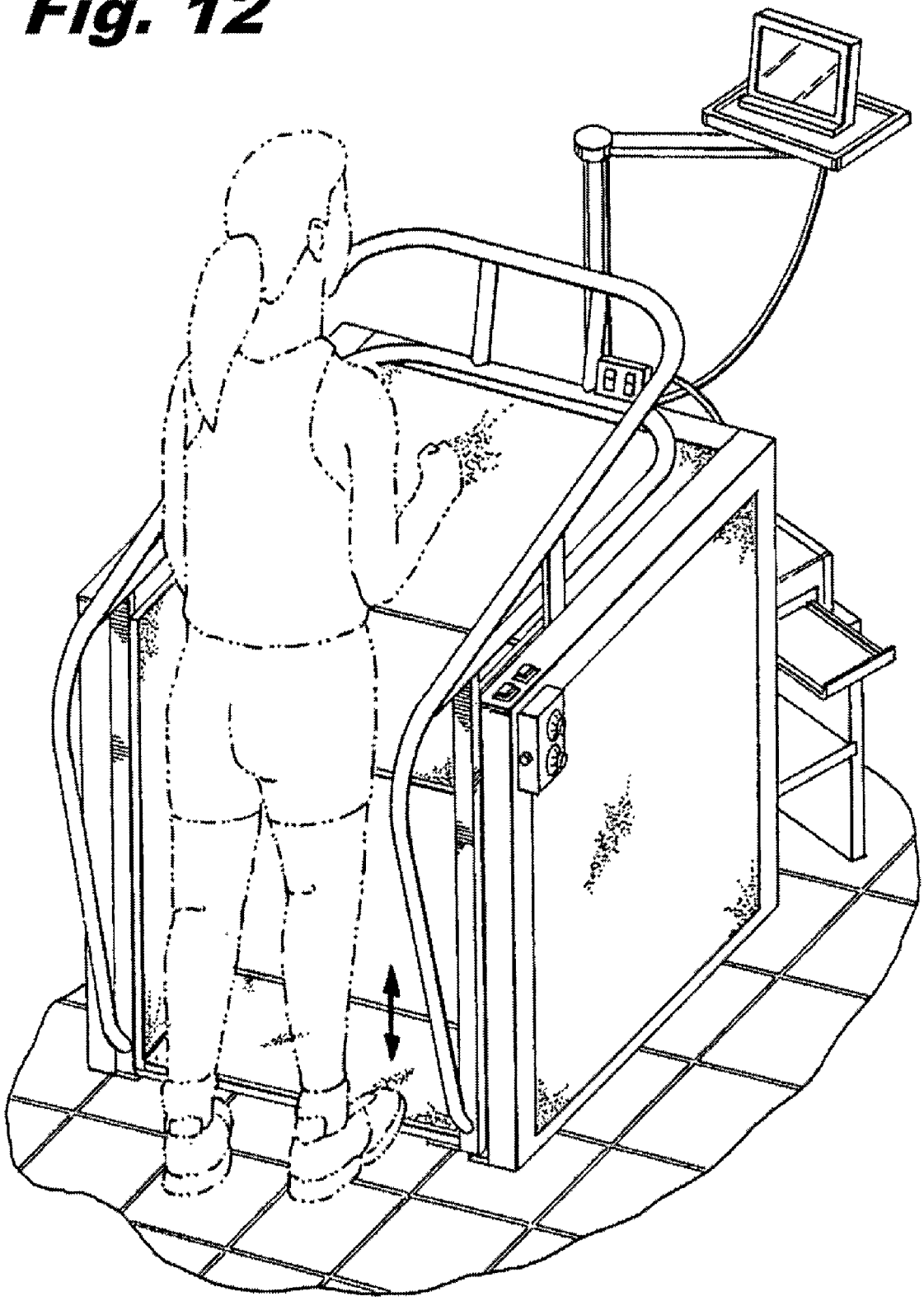
FIG. 12 illustrates the use of the machine of FIG. 1 to perform a calf stretch.

FIG. 12 illustrates the patient performing a calf stretch using assisted stair training machine 100. To perform this exercise, the patient stands facing movable platform 106 in the lower position. The patient then puts the forefoot of her affected leg over the edge of movable platform 106. Next, up/down switch 146 is activated such that movable platform 106 moves upward until the patient feels a good stretch in the calf without knee flexion. Stretch intensity and frequency may be determined by the physical therapist working with the patient.

Figure 13:
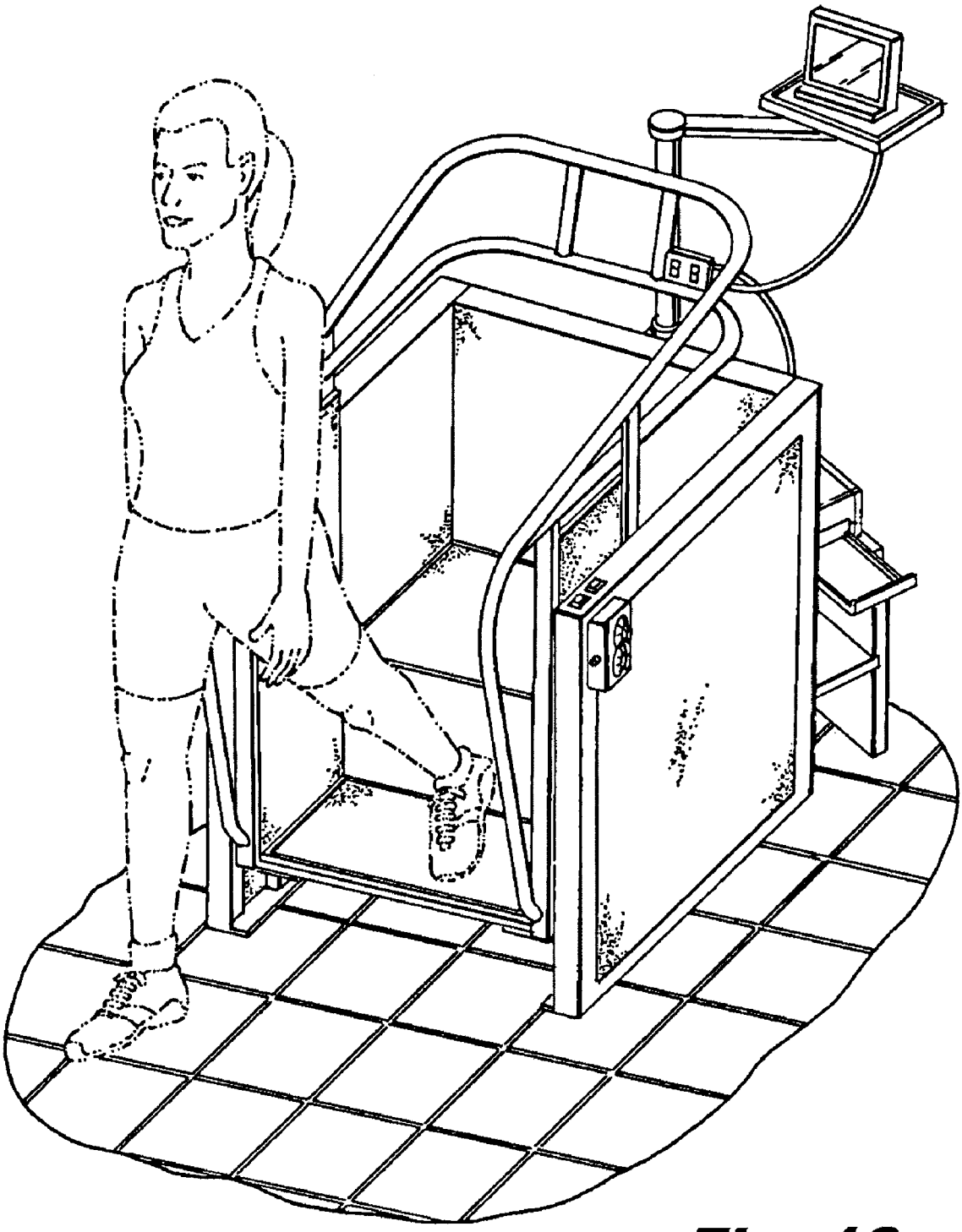
FIG. 13 illustrates the use of the machine of FIG. 1 to perform a quadriceps stretch.

FIG. 13 illustrates the patient performing a quadriceps stretch using assisted stair training machine 100. To perform this exercise, the patient stands facing away from the movable platform 106, as shown in FIG. 13. Movable platform 106 is set at the lower position, that is, its lowest height. The patient then places the foot of her affected leg over the edge of movable platform 106. Next, movable platform 106 is moved upward by engaging the up/down switch on assisted stair training machine 100 until patient feels a good stretch in the quadriceps without hip flexion. In one exemplary embodiment, the intensity and frequency of the quadriceps stretch is determined by the physical therapist working with the patient.

Figure 14:
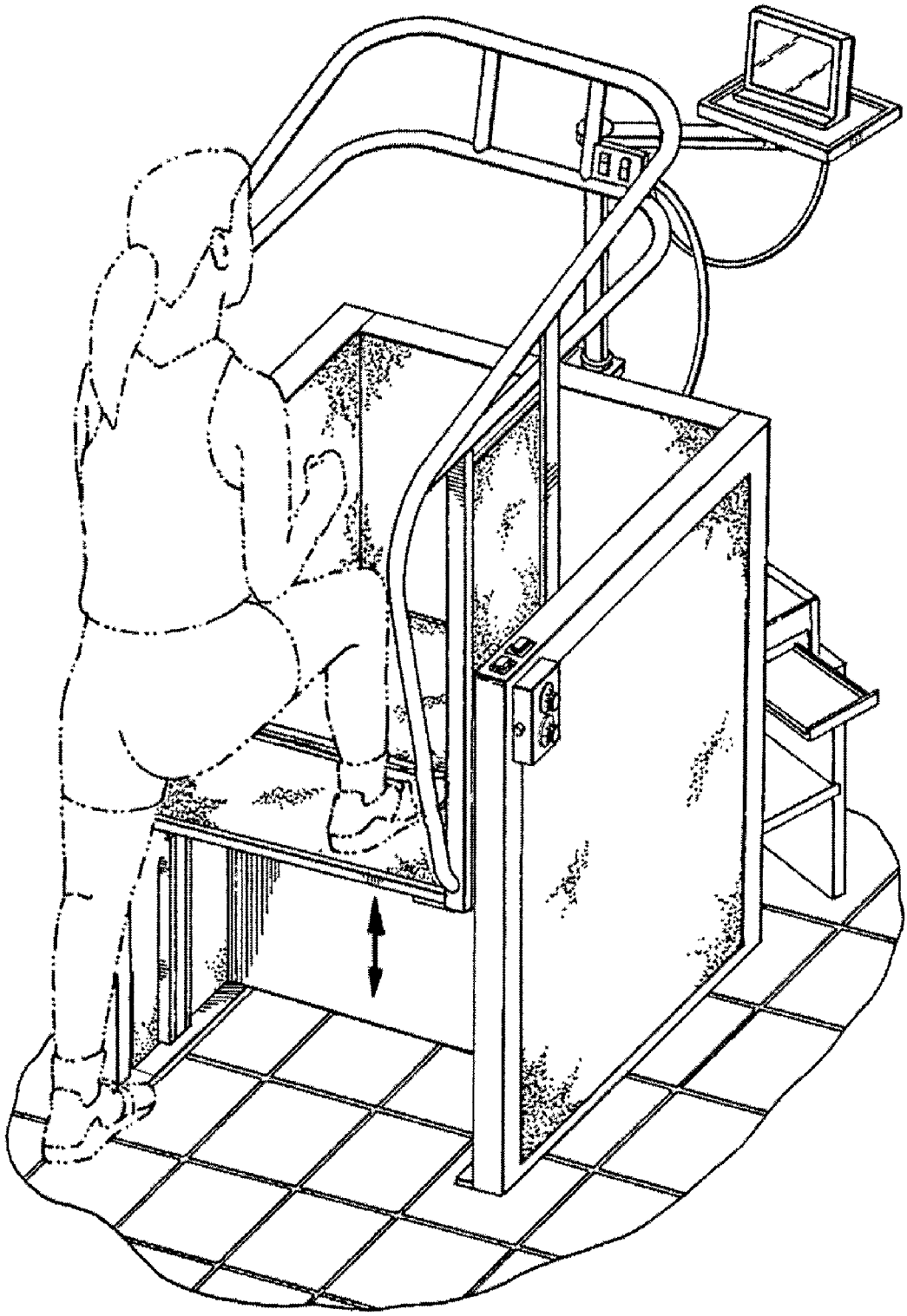
FIG. 14 illustrates the use of the machine of FIG. 1 to perform a an external oblique strengthening and hip flexor stretching exercise.

FIG. 14 illustrates the patient using the assisted stair training machine 100 to perform an external oblique strengthening with hip flexor stretching exercise. To perform this exercise, the patient stands facing movable platform 106. Movable platform 106 may be set in the upper position, as shown in FIG. 2, or in the lower position, as shown in FIG. 1, as a starting position depending on the condition of the patient as determined by the physical therapist.

When performing this exercise with movable platform 106 starting in the lower position, the patient places the foot of her affected leg onto movable platform 106 while keeping the other foot on the floor. Next, the patient flattens the lower back by sucking in her stomach using the external oblique muscle. The patient then places one hand on the lower back and the other on the oblique muscle of the affected side for tactile feedback. Movable platform 106 is then moved upward, and the patient's affected foot will be moved upward at the speed of movable platform 106, by the movable platform. In a later stage of rehabilitation, the patient may attempt moving the affected leg at the same speed as moving platform 106, if the patient has developed enough external oblique muscle control while maintaining lumbar spine flexion. While performing this exercise, the patient should maintain minimal weight on movable platform 106 to 90° hip flexion and move the leg down at the speed of movable platform 106 while controlling lumbar spine flexion using the external oblique muscle and without putting excessive weight on movable platform 106. This exercise can also be started in reverse order, meaning that the starting position will be 90° hip flexion and the foot will be moved down from this position by moving the platform downward. As the exercise becomes easier with each session, the patient should try to continue decreasing the weight put on the foot of the affected side during subsequent sessions. Once the patient is able to independently carry almost all of the weight of the leg at a specific speed, the exercise can be made more difficult by decreasing the speed of the concentric phase and increasing the speed of the eccentric phase or vice versa. In one exemplary embodiment, the patient completes three sets of 6 to 10 repetitions of this exercise.

Figure 15:
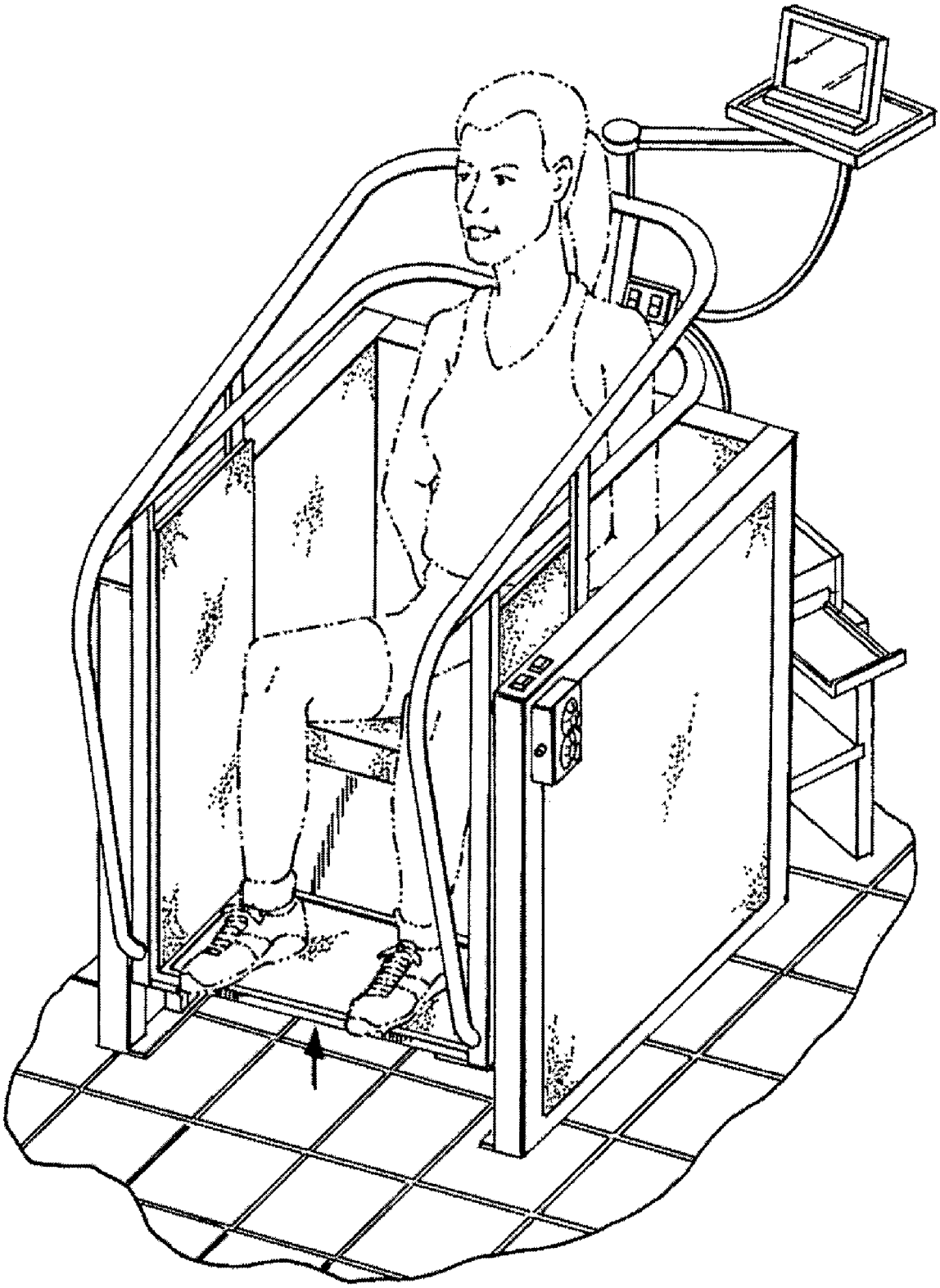
FIG. 15 illustrates the use of the machine of FIG. 1 to train the long and weak ilopsoas muscles.

FIG. 15 illustrates a patient using the assisted stair training machine 100 to train the long and weak ilopsoas muscle. To perform this exercise, movable platform 105 is set at the lower position. The patient sits on stationary platform 104 with her feet on movable platform 106. Extra cushion under the hips may be used to get the hips and knees at 90° flexion. The patient then places the foot of the affected leg on movable platform 106 while the other foot is placed on an extra stool or block (not shown in FIG. 15) on the floor next to movable platform 106 to keep the foot clear of movable platform 106. The moving step 106 is then moved upward, and the patient lifts the thigh of her affected leg up without excessive effort and at the speed of the movable platform while maintaining the foot constantly on the lower step with as little weight as possible on the platform. The patient should be instructed to stop the movement of the platform or ask to stop the movement of the platform if she experiences a pinch or pain in her hip or lower back, otherwise the patient should be allowed to go in to 125° of hip flexion. The patient should try to continually decrease the weight on foot of the affected side with every session as it becomes easier. Once the patient is able to lift nearly all of the leg weight independently at a specific speed, the difficulty of the exercise can be increased by decreasing speed of the concentric phase and increasing the speed of the eccentric phase or vice versa. In one exemplary embodiment, the patient completes three sets of 6 to 10 repetitions of this exercise.

Figure 16:
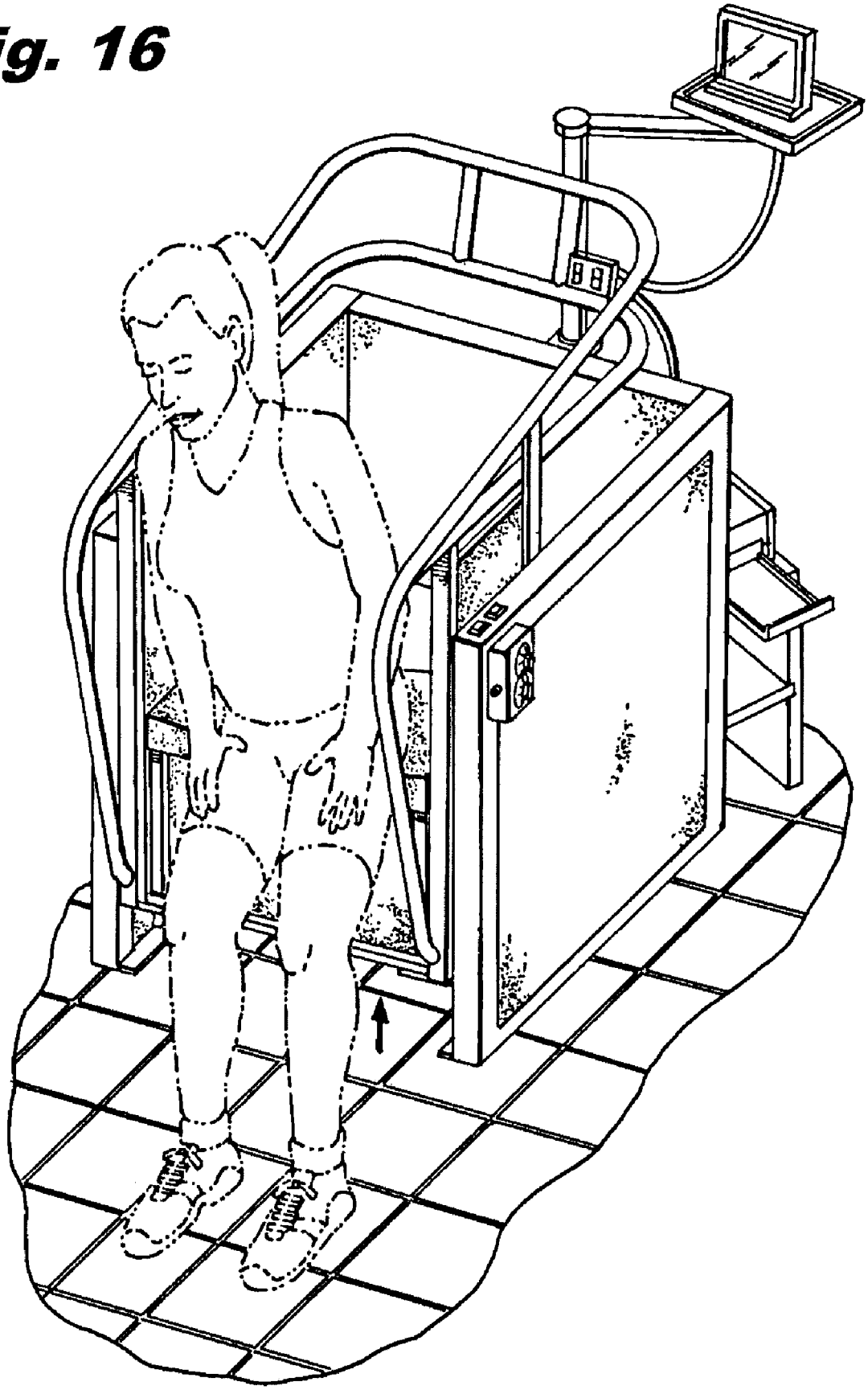
FIG. 16 illustrates the use of the machine of FIG. 1 to perform stand-to-sit training and sit-to-stand training.

FIG. 16 illustrates the use of assisted stair training machine 100 to perform stand-to-sit training. To begin this exercise, movable platform 106 is positioned in the upper position shown in FIG. 2. The patient sits on the edge of movable platform 106 with both feet on the floor. Movable platform 106 then travels downward, while the patient maintains her body weight on her feet and keeps her buttocks lightly touching the movable platform, if possible. If this is not possible, the patient will do her best while the lower step is moving up and down. With each session, the patient should try to increase the weight that is being placed on her feet. Once the patient is able to independently carry almost her full body weight on her feet at a specific speed, the training can be made more difficult by decreasing the speed of the concentric phase and increasing the speed of the eccentric phase or vice versa. In one exemplary embodiment, the patient completes three sets of 6 to 10 repetitions of this exercise. Performing sit-to-stand training can be done in a similar manner, with movable platform 106 starting at the lower position. In this case, it may be necessary to use assistance chair 152.

The present invention, as described above and shown in the drawings, provides for an assisted stair training machine and methods for using the machine. It will be apparent to those skilled in the art that various modifications and variations can be made to the systems and methods of the present invention without departing from the scope of the invention as outlined in the appended claims and their equivalents.

The invention claimed is:

1. An assisted stair training machine comprising:

a frame;

a stationary platform rigidly attached to the frame to prevent any movement of the stationary platform, the stationary platform having a planar upper surface positioned parallel to a reference plane and at a predetermined distance above the reference plane;

a movable platform configured to move with respect to the stationary platform, the movable platform having a planar upper surface and being configured to move from a first position, wherein the planar upper surface of the movable platform is substantially level with the reference plane, to a second position, wherein the planar upper surface of the movable platform is substantially level with the planar upper surface of the stationary platform; and a lifting mechanism configured to move the movable platform, in a vertical direction only, from the first position to the second position and from the second position back to the first position at a predetermined speed;

wherein the upper planar surface of the movable platform remains parallel to the reference plane throughout the movement of the movable platform.

2. The machine of claim 1, wherein the frame encloses the stationary platform on three sides.

3. The machine of claim 1, further comprising an adjustable railing connected to the movable platform and configured to move with the movable platform.

4. The machine of claim 3, further comprising at least one heart rate sensor integrated into the railing and interfacing with a computer to display heart rate information for a user of the machine.

5. The machine of claim 1, further comprising at least one pressure sensor positioned beneath the movable platform.

6. The machine of claim 1, further comprising at least one pressure sensor positioned beneath the stationary platform.

7. The machine of claim 5, further comprising a computer interfacing with the at least one pressure sensor and providing a display that indicates the amount of pressure being applied to the movable platform.

8. The machine of claim 7, wherein the computer is mounted to the frame using a swivel arm.

9. The machine of claim 1, wherein the lifting mechanism comprises a controller interfacing with a motor.

10. The machine of claim 9, wherein the motor is operable connected to the movable platform by means of a rotating shaft, a drum, a cable, and plurality of pulleys.

11. The machine of claim 9, further comprising a control box allowing a user to independently change the speed at which the movable platform moves in an upward direction and in a downward direction.

12. The machine of claim 1, wherin the lifting mechanism is further configured to move the movable platform, in a vertical direction only, from the second position to a third position, wherein in the third position, the planar upper surface of the movable platform is a predetermined distance above the planar upper surface of the stationary platform.

* * * * *